US011858603B1

(12) United States Patent
Schreiber

(10) Patent No.: US 11,858,603 B1
(45) Date of Patent: Jan. 2, 2024

(54) HULL SCRUBBER DEVICE FOR A WATER VESSEL

(71) Applicant: Sigismund Schreiber, Crestline, CA (US)

(72) Inventor: Sigismund Schreiber, Crestline, CA (US)

( * ) Notice: Subject to any disclaimer, the term of this patent is extended or adjusted under 35 U.S.C. 154(b) by 262 days.

(21) Appl. No.: 17/178,617

(22) Filed: Feb. 18, 2021

Related U.S. Application Data

(60) Provisional application No. 63/044,485, filed on Jun. 26, 2020.

(51) Int. Cl.
*B63B 59/06* (2006.01)
*B63B 21/20* (2006.01)

(52) U.S. Cl.
CPC ..... *B63B 59/06* (2013.01); *B63B 21/20* (2013.01); *B63B 2059/065* (2013.01)

(58) Field of Classification Search
CPC .... B63B 59/06; B63B 21/20; B63B 2059/065
USPC ..... 114/222
See application file for complete search history.

(56) References Cited

U.S. PATENT DOCUMENTS 185,081 A * 12/1876 Corning ..... B63B 59/08 114/222
4,395,966 A 8/1983 Murphy
4,648,344 A 3/1987 Burgers et al.
4,843,995 A 7/1989 Bingham
4,909,173 A 3/1990 Strong
5,209,176 A 5/1993 Pompei
8,651,039 B2 2/2014 Newt et al.
2008/0282957 A1* 11/2008 Palmby ..... B63B 59/08 114/222
2013/0133149 A1 5/2013 Higgins et al.
2016/0302638 A1 10/2016 Haegermarck

FOREIGN PATENT DOCUMENTS

WO WO-2015189692 A2 * 12/2015 ..... B08B 1/002

* cited by examiner

*Primary Examiner* — Anthony D Wiest
(74) *Attorney, Agent, or Firm* — Suzanne Kikel, Patent Agent

(57) ABSTRACT

A hull scrubber device for a boat is deployed into an operative mode when the boat travels through the water. The device includes a mounting pole and a flexible hull scrubber head attached to the mounting pole and tethered via a tether rope and a swivel mounting in the hull scrubber head. The device is structured to rotate or spin and hit against the boat hull as the boat moves through the water. The scrubber head is a flat-like spiral disk when in a storage, inoperative mode. This disk assumes the shape of a cylinder when hull scrubber device is fully deployed in the water. Brush elements, felt pad elements, and scraper elements are mounted on an outer edge surface of the hull scrubber head for cleaning the hull. Related methods of cleaning a boat hull are also disclosed.

11 Claims, 2 Drawing Sheets

HULL SCRUBBER DEVICE FOR A WATER VESSEL

CROSS REFERENCE TO RELATED APPLICATIONS

This application claims priority to U.S. Provisional Patent Application Ser. No. 63/044,485 filed Jun. 26, 2020 and entitled "Underway Hull Scrubber", the disclosure of which is incorporated herein by reference in its entirety.

BACKGROUND OF THE INVENTION

1. Field of the Invention

The present invention relates to a scrubber device for scrubbing the hull of a water vessel, such as, for example, a boat or a ship for the cleaning and maintenance thereof.

2. Brief Description of the Prior Art

It has been widely known for years that marine growth and other contaminants clinging to the bottom of a boat impair the boat's performance. A hull with heavy growth can cause up to about 50% performance loss. Yet, hull cleaning is near the top of regular maintenance operations that boat owners must perform and is also the least favorite chore due to the cost and time involved. Naturally, this results in boat owners not performing the cleaning of the hull often enough, and therefore, accepting the non-performance penalty it creates.

Presently, there are at least two primary ways of cleaning boat hulls. The most common practice involves hiring a scuba diver to go down into the water and to scrape the growth from the bottom of the boat with scrapers, brushes, etc. This method oftentimes tends to be expensive and time consuming; and in some instances, this method is subject to the availability of the diver and/or the equipment needed for the task.

Another common practice is to haul the boat out of the water, and to pressure wash and/or scrape the bottom of the boat on land. This method can be extremely expensive, and again, may be subject to the availability of the haul-out equipment. Most marinas have size and weight limits that their lifts can accommodate. It can also be difficult to schedule haul-out resulting in the necessity for the boater to work around the schedule of the marina.

Cruisers frequently travel long distances between destinations and need to find services in unknown locations which can sometimes be impossible. Having the ability to take care of these maintenance operations anywhere and at anytime would be a welcomed option for any cruiser.

While the prior art may provide for means and methods for cleaning the hull of a water vessel, such as a boat or ship, the means and methods of the prior art tend to be inefficient. For example, Published Patent Application No. 2016/0302638 discloses a robotic cleaner. However, this device tends to be expensive and complicated.

There is, therefore, a need in the art to provide a simple, inexpensive means for efficiently and effectively cleaning the hull of a water vessel.

There is a further need in the art to provide a means which eliminates the delay and expense involved in dry docking water vessels for cleaning and maintenance purposes.

SUMMARY OF THE INVENTION

The present invention meets these needs. The present invention provides a hull scrubber device for cleaning the hull of a water vessel, such as a boat, that is deployed while a boat travels through the water. The hull scrubber device comprises a mounting pole having a base end and a distal end; a tether rope having a first end attached to the distal end of the mounting pole and a second end spaced away from the first end of the tether rope and spaced away from the hull; and a hull scrubber head having a first end attached to the tether rope and a distal end spaced away from the hull, the hull scrubber head being made of a flexible material and in a spiral shape configuration when in an inoperative mode and essentially in a cylinder shape configuration when in an operative mode.

The mounting pole may be either mounted to the boat deck, or it may be hand held by an operator of the hull scrubber device. The hull scrubber head of the hull scrubber device transforms essentially into a cylinder configuration when in a fully operative mode in the water and spins or rotates against the hull as the boat moves through the water and uses the movement of the boat to assist in the hull cleaning process, thereby increasing the efficiency of the cleaning process.

The mounting pole, in general, is used to position and hold the hull scrubber head out over the hull and aids in allowing the hull scrubber head to freely spin or rotate under and alongside and is pushed against the boat hull for the hull cleaning process. The mounting pole can also be used to position the hull scrubber head in the vicinity of the boat hull which needs to be cleaned.

The hull scrubber head is, initially, a flat disk which is cut into a spiral configuration, and which has a base and an apex. The base has a first dimension and the apex has a second dimension with the first dimension of the base being greater than that of the second dimension of the apex so that the hull scrubber head assumes the shape of a spiral when initially deployed in the water. However, this spiral configuration quickly assumes a cylinder configuration as the hull scrubber head is fully deployed in the hull cleaning process. During the cleaning process, the hull scrubber head spins or rotates and hits against the hull thereby cleaning the bottom of the boat hull.

In an embodiment of the invention, the hull scrubber head includes a plurality of brush elements, felt pad elements, and scraper elements which are mounted on outer edge surfaces of the hull scrubber head and which eliminate the contaminants to clean the hull. The hull scrubber head is constructed to be collapsible into a flat planar shape with the apex being encircled by the base for easy storage of the hull scrubber device on the water vessel.

A method of the invention comprises the steps of deploying the hull scrubber head of the hull scrubber device over the bow of the water vessel and below a water line to position the hull scrubber head adjacent to the bow of the water vessel and below the water line; and moving the water vessel through the water. While the water vessel moves through the water, the hull scrubber head assumes essentially a cylinder shape and is caused to rotate or spin against the hull of the water vessel to conform to the shape of the hull for cleaning of the hull. The brush elements, the felt pad elements, and the scraper elements on the hull scrubber head are forced against the hull to clean the hull.

The hull scrubber device of the invention provides the ability to clean the hull of a water vessel when and while the water vessel is in motion through the water.

In a further embodiment of the invention, the tether may be a lanyard with a fastener or similar hardware provided at its one end which is fixedly secured in the swivel mounting so that the tether is fixedly secured to the hull scrubber head via the swivel mounting. In a preferred embodiment of the invention, the hull scrubber head is attached to a mounting pole which allows the operator of the hull scrubber device to control the hull scrubber device, and therefore, the hull scrubber head, and to alter the positioning or placement of the hull scrubber device to either the port or the starboard side of the water vessel.

These and other features and advantages of the present invention will be better appreciated and understood when the following description is read in light of the accompany drawings.

BRIEF DESCRIPTION OF THE DRAWINGS

The components in the figures are not necessarily to scale, emphasis instead being placed upon illustrating the principles of the invention. Moreover, in the figures, like reference numerals designate corresponding parts throughout the different views.

DETAILED DESCRIPTION OF THE INVENTION

Figure 2:
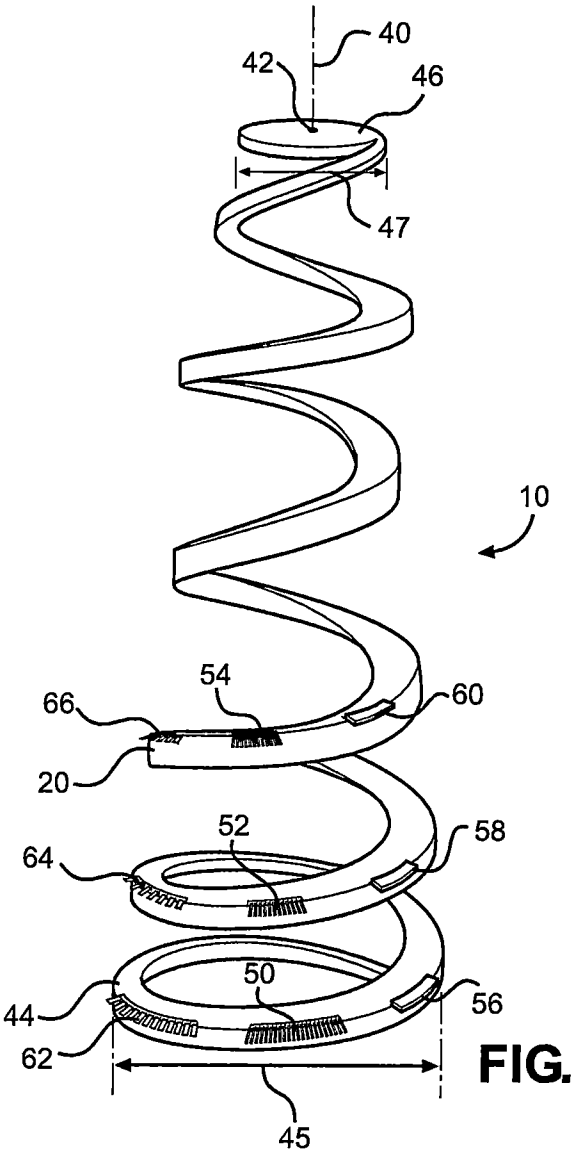
FIG. 2 is an enlarged, side perspective view of the hull scrubber device of the invention in an extended, operative mode.
Figure 1:
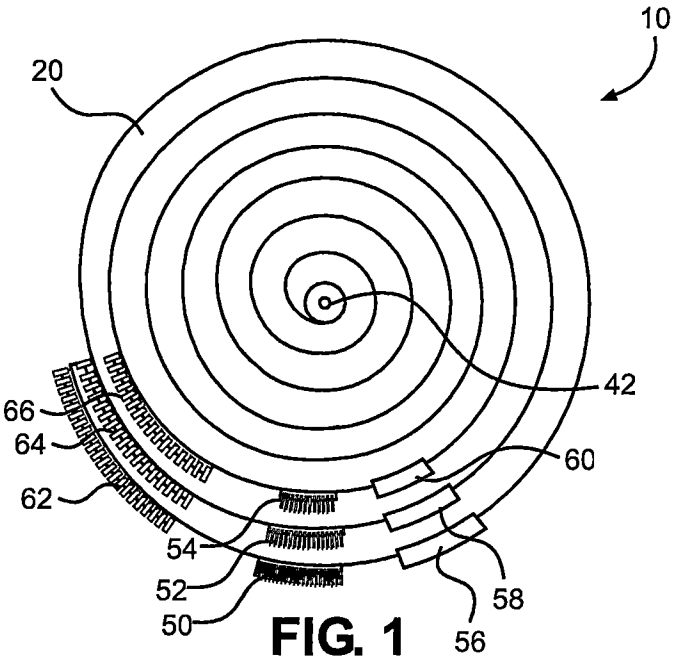
FIG. 1 is an enlarged, top view illustrating the hull scrubber device of the invention in a flat planar, collapsed, and inoperative mode.
Figure 3:
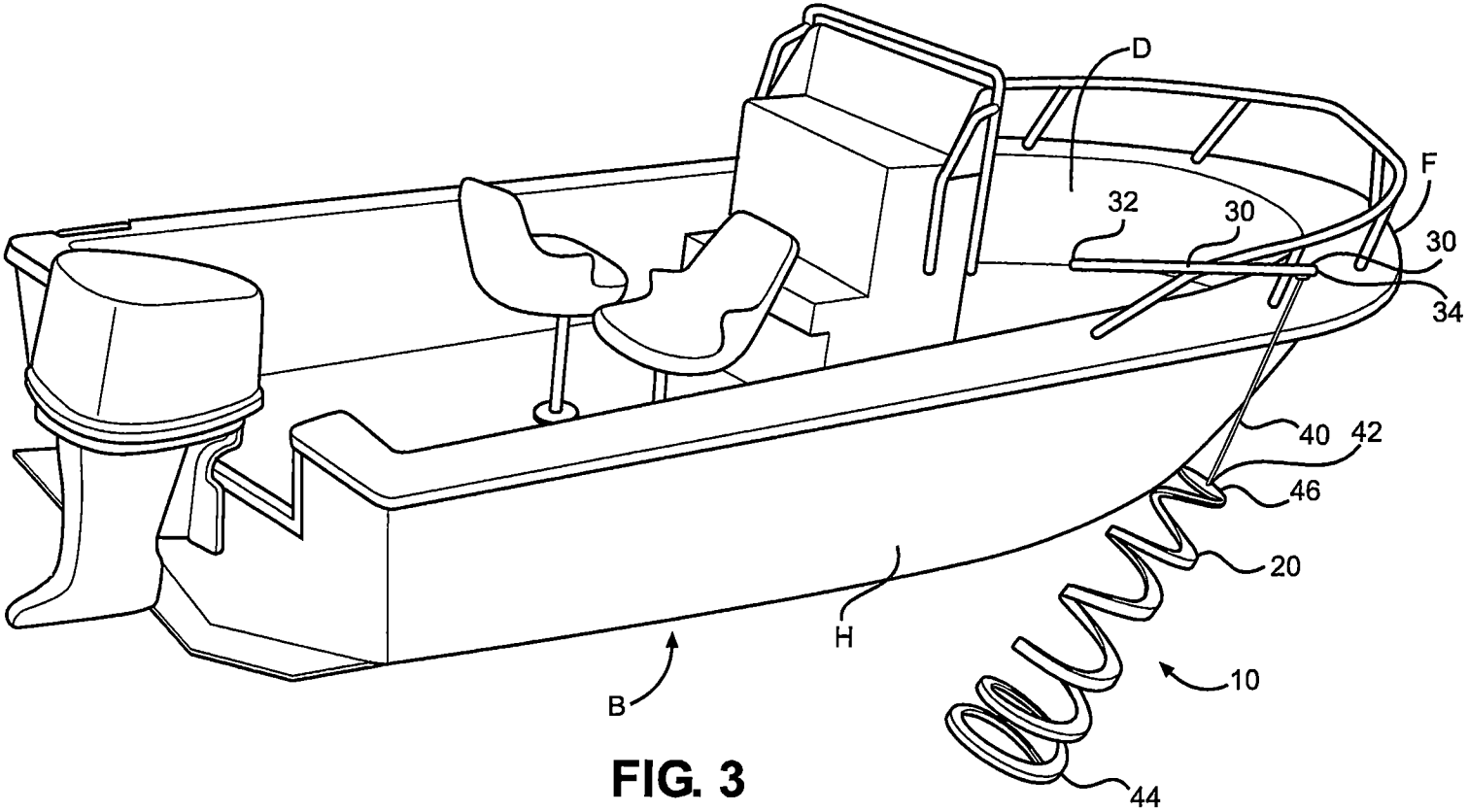
FIG. 3 is a perspective view of a boat schematically illustrating the boat hull scrubber device of the invention in an extended, operative mode.

Referring to FIGS. 1 through 3, it can be understood that the present invention pertains to a hull scrubber device 10 for cleaning a hull H of the boat B as the boat moves forward through the water. As best shown in FIG. 2, hull scrubber device 10 comprises a mounting pole 30, a hull scrubber head 20, a swivel mounting 42 connected to the upper end of the scrubber head 20, and a tether rope 40 fixedly attached at its one end to the swivel mounting 42. Still referring to FIG. 2, hull scrubber head 20 is comprised of a spiral-cut flat disk which is made generally of a flexible spring-like material. As best shown in FIG. 3, boat scrubber head 20 is connected to mounting pole 30 which is located at the front F of boat B. Mounting pole 30 has a base 32 and a distal end 34, and the other end of tether rope 40 is connected to the distal end 34 of mounting pole 30.

Referring particularly to FIG. 3, base 32 of mounting pole 30 is secured to deck D of boat B toward the front F of the boat B, and distal end 34 of mounting pole 30 extends away from the boat and out over the hull H of the boat and supports tether rope 40, swivel mounting 42, and hull scrubber head 20 of hull scrubber device 10. It is to be appreciated that mounting pole 30 may either be attached to the boat B as illustrated in FIG. 3, or the mounting pole 30 may be hand held by an operator to position the hull scrubber head 20 in a desired area of the hull which is to be cleaned.

Figure 4:
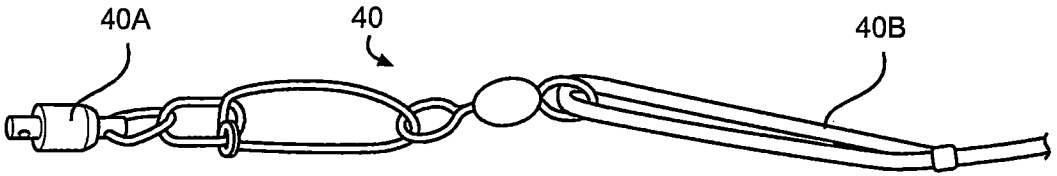
FIG. 4 is an enlarged, side perspective view illustrating an example of a tether rope.

Tether rope 40 may be a shock absorbing and is readily available in the marketplace. FIG. 4 shows an example of a tether rope 40 which may be used in the invention. As can be seen, tether rope 40 has a fastener element 40*a* at its one end and a mounting end 40*b*. Fastener element 40*a* is inserted into mounting swivel 42 of hull scrubber head 20 as particularly illustrated in FIG. 2. It is important to note that fastener element 40*a* is attached to hull scrubber device 10 at mounting swivel 42 and prevents or lessens any twisting and/or fouling of tether rope 40.

Tether rope 40 may be made of tubular nylon webbing; may have a length greater than 5 feet; and may hold a weight capacity greater than 10 pounds. It is to be appreciated by those skilled in the art that the length of tether rope 40 is adjusted to enable the operator of hull scrubber device 10 to reach the entire length of the hull fore and aft (front or back).

Referring particularly to FIG. 2, hull scrubber head 20 is in a spiral configuration, which is a semi-expanded configuration for hull scrubber head 20. It is to be further appreciated, that hull scrubber head 20 is in an essentially conical cylinder configuration when in an operative mode. Still referring to FIG. 2, hull scrubber head 20 has a base 44 and an apex 46. The dimension of base 44 is indicated by reference number 45 and the dimension of apex 46 is indicated by reference number 47. As seen in FIG. 2, the dimension of base 44 is greater than that of apex 46. It is to be appreciated that the dimension of base 44 will decrease as hull scrubber head 20 extends downwardly, and at some point, the dimension of base 44 and that of apex 46 will be about the same, at which point hull scrubber head 20 will be closer to the shape of a conical cylinder when in an operative mode and subject to the pressure of the water as the vessel moves through the water as shown in FIG. 2. It is to be appreciated, that when the hull scrubber head 20 is in an inoperative mode, it assumes a flat coil spring shape.

The flexibility and the shape of hull scrubber head 20 of hull scrubber device 10 with base 44 positioned below the water line permits the hull scrubber head 20 to conform to the hydrodynamic shape of hull H of the boat to increase the wiping and/or scraping action of hull scrubber head 20 against the boat hull as the boat travels through the water. This action causes the water to force hull scrubber head 20 to rotate or spin against the hull as the boat moves forward through the water. This rotating or spinning action results in hull scrubber device 10 cleaning the boat hull.

As discussed herein above, hull scrubber device 10 is initially in the form of a flat spiral disk as shown in FIG. 1. It is to be appreciated that this flat disk form is desirable for storage purposes. Furthermore, it is to be appreciated that prior to hull scrubber device 10 being in an operative mode as illustrated in FIGS. 2 and 3, that hull scrubber device 10 was in an inoperative, storage mode as illustrated in FIG. 1. Referring again to FIGS. 1 and 2, suitable brush elements such as those shown at reference numbers 50, 52 and 54; suitable felt pad elements such as those shown at reference numbers 56, 58, and 60; and suitable scraper elements such as those shown at reference numbers 62, 64 and 66 may be mounted along outer edge surfaces of hull scrubber head 20. These brush elements 50, 52 and 54; felt pad elements 56, 58, and 60; and scraper elements 62, 64 and 66 are used for the brushing, wiping and scraping action of hull scrubber head 20 against the boat hull H.

Even though FIGS. 1 and 2 illustrate brush elements 50, 52, and 54; felt pad elements 56, 58 and 60; and scraper elements 62, 64 and 66 as being located on a lower portion of hull scrubber head 20, it is to be appreciated that these elements may be mounted along the entire perimeter of hull scrubber 20. When fully in use, hull scrubber head 20 will extend into a shallow cone or cylinder with the same diameter from top to bottom with reference to FIG. 2. The result is that hull scrubber head 20 may be similar to a rotating brush used in a car wash. That is, hull scrubber head 20 will scrub the entire length to which it has been extended.

In use, hull scrubber device 10 is extended from its stored, inoperative mode of FIG. 1 such that scrubber head 20 is unfurled as shown in FIG. 2, and when in its fully operational mode, hull scrubber device 10 takes the form of a cylinder. Scrubber device 10 is attached to pole 30 via tether rope 40, and scrubber head 20 with tether rope 40 attached to swivel mounting 42 is dropped into the water adjacent to the hull. Once the boat gets underway through the water, scrubber head 20 of hull scrubber device 10 is forced against the hull H to scrape contaminants and/or marine organism from the hull. In this process, hull scrubber head 20 will tend to extend rearward, below the waterline, and will spin relative to the boat hull. It can be appreciated that hull scrubber device 10 operates to scrub and clean the boat hull during movement of the boat through the water.

Hull scrubber device 10, in general, effectively operates on boats up to approximately 45 feet in length. For boats longer than 45 feet, a more complex device may need to be utilized using wind, hydro and/or electric power to aid in the positioning of the scrubber element. Many upgrades could be used which would include a delivery device from automation to video monitoring to enable a user to visually monitor the scrubbing progress being made.

Hull scrubber head 20 of device 10 is designed to operate best at boat speeds in the 5 to 8 knots range which makes it ideal for use on sail boats. Hull scrubber head 20 can be made of a thicker and/or stiffer material in order to function effectively at higher speeds but may not be effective or safe at speeds over 15 to 20 knots.

For use on power boats (propeller driven), it is recommended that safety precautions be taken to ensure that the scrubber head 20 and/or tether rope 40 do not come into contact with the boat's motor or rotating drive. Typical drives are in the aft 10 to 15% of hull length, it is recommended that the tether rope 40 be operated to limit the positioning of the hull scrubber head 20 to remain forward of the drives. Cleaning of the area aft of the drives may need to be done while the boat is being towed or done by a diver. A large displacement hull, such as on a freighter, will travel several miles when put in neutral from cruising speed, and this would most likely be far enough to allow the area aft of the drive(s) to be cleaned if the tether rope 40 is played out as drives are unpowered. Large boats are often guided in by tugboats and the hull scrubber device 10 of the invention could be allowed to extend past the drives during the towing process.

Hull scrubber device 10 of the invention tends to reduce or eliminate the need to apply anti-fouling paint on the hull bottom; is easily stored on the boat; can be used in open waters; may minimize organic growth deposition in harbor waters which commonly have poor water circulation; and may aid in preventing invasive growth transfer between geographical regions.

From the above, it can be appreciated that the invention provides a hull scrubber device for a water vessel, such as a boat, that is deployed while the water vessel travels through the water. The hull scrubber device 10 includes hull scrubber head 20 which is tethered to a pole optionally mounted on the deck of the water vessel or held by an operator. The hull scrubber head 20 spins or rotates against the hull of the water vessel as it moves through the water for the cleaning action of the device 10. Even though the utilization of only one hull scrubber device 10 is disclosed herein, it is to be appreciated that several such hull scrubber devices 10 may be employed for the cleaning of a water vessel.

It should also be appreciated that these brush elements 50, 52 and 54; felt pad elements 56, 58 and 60; and scraper elements 62, 64 and 66 are replaceable and are available in different "grits" allowing the user to select how aggressive a cleaning is desired. That is, soft sponges may be used for wiping off slime and stiff brushes may be used for medium weed growth or the scraping off the attached barnacles. It is to be further appreciated that that hull scrubber head 20, preferably, is made of material that is non-abrasive and not subject to corrosion.

While the present invention has been described in connection with a preferred embodiment of the figures, it is to be understood that other similar embodiments may be used or modifications and additions may be made to the described embodiment for performing the same function of the present invention without deviating therefrom. Accordingly, it is intended by the appended claims to cover all such changes and modifications as come within the spirit and scope of the invention.

What is claimed is:

1. A hull scrubber device for use on a water vessel having a deck and a hull, the hull scrubber device, comprising:

a mounting pole having a base end and a distal end;

a tether rope having a first end attached to the distal end of the mounting pole and a second end spaced away from the first end of the tether rope and spaced away from the hull; and a hull scrubber head having a first end attached to the tether rope and a distal end spaced away from the hull, the hull scrubber head being made of a flexible material and having an apex and a base, and structured to be collapsible into a flat coil spring shape with the apex being encircled by the base when the hull scrubber device is in an inoperative mode and essentially in a conical cylinder shape when in an operative mode and subject to the pressure of the water as the water vessel moves through the water.

2. The hull scrubber device of claim 1, wherein the hull scrubber head has an outer edge surface, and wherein the hull scrubber head further includes a plurality of cleaning elements mounted along and on the outer edge surface of the hull scrubber head.

3. The hull scrubber device of claim 2, wherein the plurality of cleaning elements comprises brush elements, felt pad elements, and scraper elements.

4. The hull scrubber device of claim 1, wherein the hull scrubber head is structured to be collapsible into a flat coil spring shape with the apex being encircled by the base when the hull scrubber device is in an inoperative mode.

5. The hull scrubber device of claim 1, wherein the hull scrubber head is comprised of a spiral-cut flat disk which is made generally of a flexible spring-like material.

6. The hull scrubber device of claim 1, wherein the device further comprises a swivel mounting positioned within the hull scrubber head for securing the tether rope to the hull scrubber head.

7. A method for cleaning a hull of a water vessel, the steps comprising:

providing a hull scrubber device which is attached to a mounting pole and which is extendable outwardly from a deck of the water vessel and having a base end removably fixed to the deck adjacent to a hull of the water vessel and a distal end spaced away from the end of the hull; a tether rope attached to the distal end of the mounting pole; and a hull scrubber head having a first end attached to the tether rope, the hull scrubber head being flexible and which hull scrubber head initially assumes a flat coil spring shape when in an inoperative mode and assumes essentially a conical cylinder shape when in a fully operative mode and subject to the pressure of the water as the vessel moves through the water;

deploying the hull scrubber head over the bow of the water vessel and below a water line to position the hull scrubber head closely adjacent to the bow of the water vessel and below the water line;

moving the water vessel through the water; and causing the hull scrubber head to assume the shape of a cylinder and to spin against the hull of the water vessel below the water line as the water vessel moves through the water for cleaning the hull of the boat.

8. The method of claim 7, wherein the hull scrubber head has an apex and a base, and the steps further comprising collapsing the hull scrubber head to a flat coil spring shape having the apex of the hull scrubber head encircled by the base thereof for an inoperative mode for the hull scrubber device.

9. A method of cleaning the hull of a water vessel, the steps comprising:

providing a flexible hull scrubber device having a hull scrubber head with an apex and a base and with a flat coil spring shape when in an inoperative mode;

placing the hull scrubber head into water forward of the water vessel and spaced away from the forward end of the water vessel;

moving the water vessel forward in the water; and causing the flexible hull scrubber head to transform into a conical cylinder shape when in an operative mode and to come into spinning contact with the hull of the water vessel by pressure of the water through which the water vessel is moving for cleaning of the boat hull.

10. The method of claim 9, the steps further comprising:

causing the flexible hull scrubber head to flex against the hull of the water vessel to conform to the shape of the hull.

11. The method of claim 9, the steps further comprising:

providing a plurality of cleaning elements on the hull scrubber head; and causing the cleaning elements to be pushed against the hull of the water vessel when the hull scrubber head is flexed against the hull of the water vessel for cleaning the hull of the water vessel.

* * * * *